US006078777A

United States Patent [19]

Imumi et al.

[11] Patent Number: 6,078,777

[45] Date of Patent: Jun. 20, 2000

[54] IMAGE FORMING APPARATUS FOR TRANSFERRING AN IMAGE RECEIVING MEMBER ON A CONVEYOR BELT

[75] Inventors: Takao Imumi, Kanagawa-ken; Takeshi Watanabe, Kangawa-ken, both of Japan

[73] Assignee: Kabushiki Kaisha Toshiba, Kawasaki, Japan

[21] Appl. No.: 09/017,804

[22] Filed: Feb. 3, 1998

[30] Foreign Application Priority Data

Feb. 10, 1997 [JP] Japan ..... 9-026459

[51] Int. Cl.[7] ..... G03G 15/16

[52] U.S. Cl. ..... 399/313; 347/153; 399/310

[58] Field of Search ..... 347/153; 399/312, 399/313, 121, 165, 310

[56] References Cited

U.S. PATENT DOCUMENTS

| | | | |
|---|---|---|---|
| 4,370,047 | 1/1983 | Damouth et al. | 399/165 X |
| 4,873,541 | 10/1989 | Hirose et al. . | |
| 5,574,550 | 11/1996 | Okazaki et al. | 399/313 |
| 5,669,054 | 9/1997 | Uchida et al. | 399/313 |

*Primary Examiner*—Susan S. Y. Lee
*Attorney, Agent, or Firm*—Foley & Lardner

[57] ABSTRACT

An electro-photographic copying apparatus includes a conveyor system for moving a transferring device between a first position of engaging a conveyor belt against a photosensitive drum and a second position of the conveyor belt being spaced apart from the photosensitive drum. In the first position, an image on the photosensitive drum may be transferred to an image receiving member. In the second position, the copying apparatus is waiting to make a copy. A tension maintaining mechanism may maintain a constant tension on the conveyor belt when the transferring device is in the first or second positions. The copying apparatus may include a discharge system for discharging the conveyor belt when a transfer roller is positioned at the second position. The copying apparatus may also include a cleaning device for cleaning the transfer roller when the transfer roller is positioned at the second position. A controller controls the rotation of the drum and the belt roller so that they move at the same speed while their moving speed changes during acceleration or deceleration. The outer diameter of the drum, the thickness of the conveyor belt and the outer diameter of the driving roller are selected so that the drum and the belt roller move at the same speed.

16 Claims, 13 Drawing Sheets

IMAGE FORMING APPARATUS FOR TRANSFERRING AN IMAGE RECEIVING MEMBER ON A CONVEYOR BELT

BACKGROUND OF THE INVENTION

1. Field of the Invention

The present invention relates to an image forming apparatus in which an image formed in an image station is transferred onto an image receiving member fed by a feeder to the image forming station, to form a visible image on the image receiving member, and more particularly, to an image forming apparatus having a conveyor belt for transferring the image receiving member.

2. Description of the Related Art

Recently image forming apparatuses have a conveyor belt for conveying an image receiving member to an image forming station where an image corresponding to image information is formed on the image receiving member.

U.S. Pat. No. 4,873,541 discloses an image forming apparatus having a conveyor belt which is moved between a first position where the conveyor belt is in contact with the photosensitive member and a second position where the conveyor belt is away from the photosensitive member. This image forming apparatus enables a user to remove the image receiving member, for example, a paper that has jammed or failed to be properly fed, by moving the conveyor belt to the second position.

Although a corona charger may be used as a transfer device, in this apparatus a transfer roller is used as the transfer device. The transfer roller is always kept in contact with the conveyor belt even if the conveyor belt is away from the photosensitive member. For this reason, a component of the conveyor belt exudes and adheres on the transfer roller, and causes damage to the belt and the transfer roller. This results in the formation of a defective image.

Further, when the photosensitive member and the belt are driven while they are kept in contact with each other, a difference is produced in their moving speeds especially during acceleration and deceleration. This also damages the photosensitive member and the belt.

SUMMARY OF THE INVENTION

One object of the present invention is to provide an image forming apparatus having a transfer device and a conveyor belt that enables forming an excellent image without exuding of the component onto the transfer device from the belt.

Another object of the present invention is to provide an image forming apparatus without causing wear to a photosensitive drum, a transfer roller and a conveyor belt.

Certain aspects of the present invention provide an image forming apparatus having image forming means to form an image on an image carrier, having transfer means for transferring the image formed on an image carrier onto an image receiving member, and having a conveying means for conveying the image receiving member to a position for the transfer of the image from the image carrier. The conveying means is movable between a first position where the conveying means is in contact with the image carrier and a second position where the conveying is spaced apart from the image carrier. The image forming apparatus also includes moving means for moving the transfer means so that the transfer means is spaced apart from the conveying means when the conveying means is positioned at the second position.

Other aspects of the present invention provide an image forming apparatus comprising image forming means for forming an image on an image carrier, transfer means for transferring the image formed on an image carrier onto an image receiving member, and conveying means, contacting with the image carrier, for conveying the image receiving member to a position for transferring the image from the image carrier. The image forming apparatus further comprising first driving means for driving the image carrier to move in one direction, second driving means for driving the conveying means to move in the same direction as the moving direction of the image carrier, and controlling means for controlling the first driving means and the second driving means so that the image carrier and the conveying means move at the same speed while the moving speed of the image carrier and the conveying means is changing.

These and other objects, features and advantages of the present invention will become clear from the following description when read in conjunction with the accompanying drawings.

DETAILED DESCRIPTION OF THE PREFERRED EMBODIMENTS

Figure 1A:
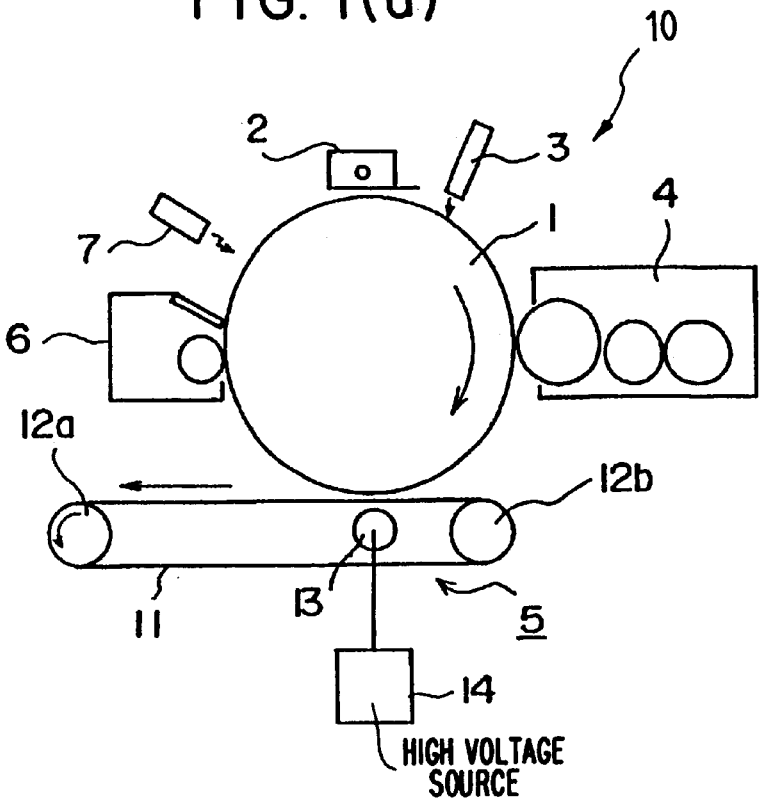
FIGS. 1(*a*) and 1(*b*) are schematic views of a electro-photographic copying apparatus according to a first embodiment of the present invention.
Figure 1B:
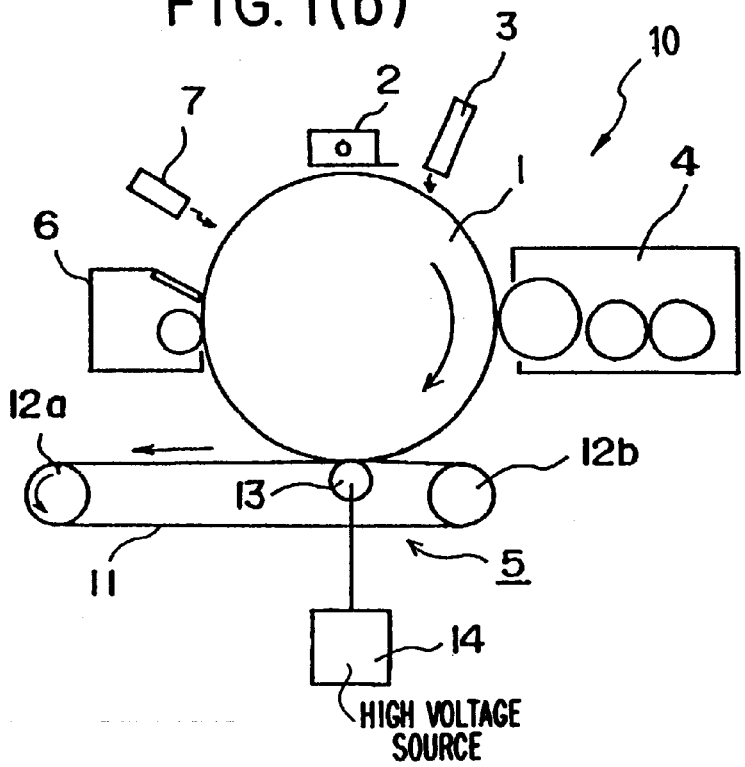

FIGS. 1(*a*) and 1(*b*) are schematic views of an electrophotographic copying apparatus 10 according to a first embodiment of the present invention. The electrophotographic copying apparatus 10 comprises a photosensitive drum 1 rotatable in the direction of an image carrier (not shown) indicated by an arrow in FIGS. 1(*a*)and 1(*b*). Around this photosensitive drum 1, the electro-photographic copying apparatus 10 comprises a main charger 2, an exposure unit 3, a developing unit 4, a transfer unit 5, a cleaning unit 6, and a charge removing discharger 7 arranged in order of the direction of rotation of the drum. The transfer unit 5 comprises an elastic belt 11, a pair of rollers 12*a* and 12*b*, a transfer roller 13, and a high voltage source 14. The elastic belt 11 has a volume resistance of $10^8$–$10^{12}$ Ω-cm. The elastic belt 11 is supported by the pair of rollers 12*a* and 12*b*. The belt 11 is supplied with a transfer voltage from a transfer roller 13, which is elastic, and also has a conductivity of volume resistance $10^2$–$10^7$ Ω-cm. The transfer roller 13 is connected to the high voltage source 14. In the transfer unit 5, the belt 11 is moved at almost the same speed as that of the photosensitive drum 1 when the roller 12*a* is driven.

Next, an image forming method of the apparatus 10 is described. First a surface of the photosensitive drum 1 is charged uniformly at −500 to −800V by the main charger 2. A light beam is applied to the charged photosensitive drum 1 by the exposure unit 3 according to the image information, and an electrostatic latent image is formed on the photosensitive drum 1. The electrostatic latent image is developed to form a visible image by the developing unit 4 using a negative charged toner.

In the transferring process, the belt 11 of the transfer unit 5 is pressed against the photosensitive drum 1 with a transfer paper disposed thereon, and a bias voltage of +300V to 5 kV is applied to the belt 11 from the high voltage source 14 via the transfer roller 13. A toner image on the photosensitive drum 1 is transferred onto an image receiving member, such as transfer paper, conveyed by the belt 11.

During a copying operation waiting time, the transfer roller 13 is at the lower position and the belt 11 is kept stretched by the driving rollers 12*a*, 12*b* at a position spaced apart, e.g., about 3 mm, from the photosensitive drum 1 as shown in FIG. 1(*a*). At this time, the transfer roller 13 and the belt 11 are separated, e.g., by a distance of about 2 mm.

On the other hand, during the copying operation, the transfer roller 13 is at the upper position, urging the belt 11 upwardly and pressing the photosensitive drum 1 via the belt 11, as shown in FIG. 1(*b*). The transfer voltage is applied to the belt 11 from the high voltage source 14 via the transfer roller 13.

Figure 2A:
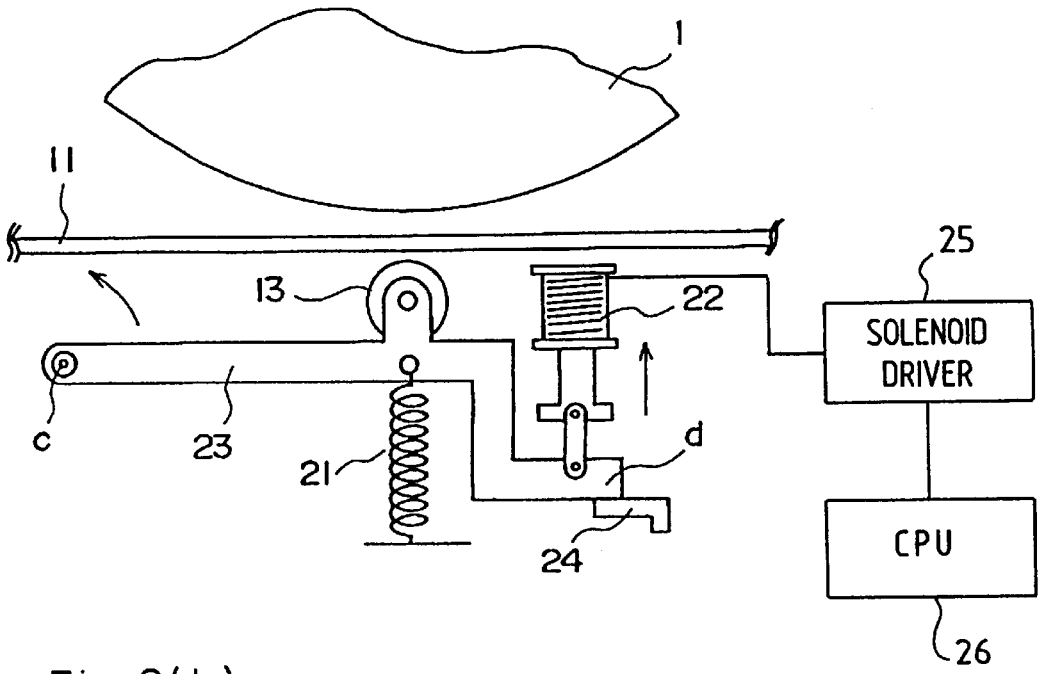
FIGS. 2(*a*) and 2(*b*) are diagrams showing a changing mechanism of the position of the transferring mechanism of the electro-photographic copy apparatus shown in FIG. 1.
Figure 2B:
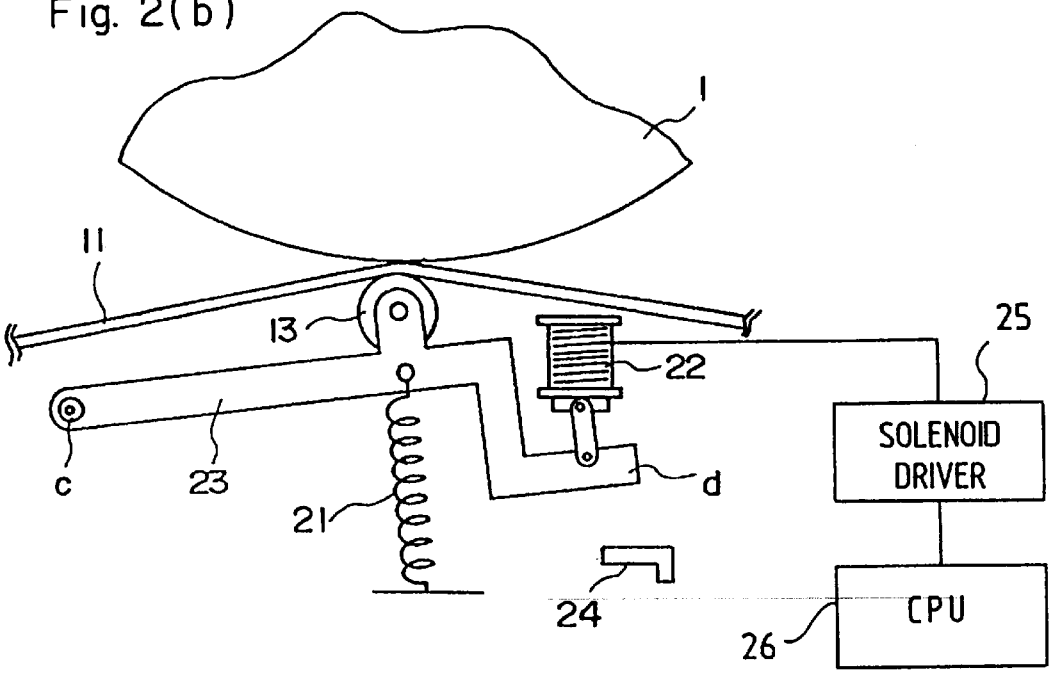

FIGS. 2(*a*) and 2(*b*) are diagrams showing a changing mechanism for changing the position of the transfer roller 13 in the electrophotographic copying apparatus 10. The changing mechanism comprises a spring 21, a solenoid 22, a supporting member 23, a positioning member 24, a solenoid driver 25, and a central processing unit (CPU) 26. The spring 21 and the solenoid 22 are connected to the supporting member 23 as shown in FIGS. 2(*a*) and 2(*b*). The supporting member 23 is mounted to both ends of the transfer roller 13 and moves pivotally around a supporting point c. The solenoid 22 is driven by the solenoid driver 25 which is connected to the CPU 26 which operates as a controller.

During the copying operation waiting time, an end "d" of the supporting member 23 is urged downward by the force of the spring 21 to engage the positioning member 24 and thereby hold the transfer roller 13 at a lower position as shown in FIG. 2(*a*). During the copying operation, the end "d" of the member 23 is urged upward by the solenoid 22 and the transfer roller 13 is held at the upper position to press the belt 11 against the photosensitive drum 1 as shown in FIG. 2(*b*).

Figure 3:
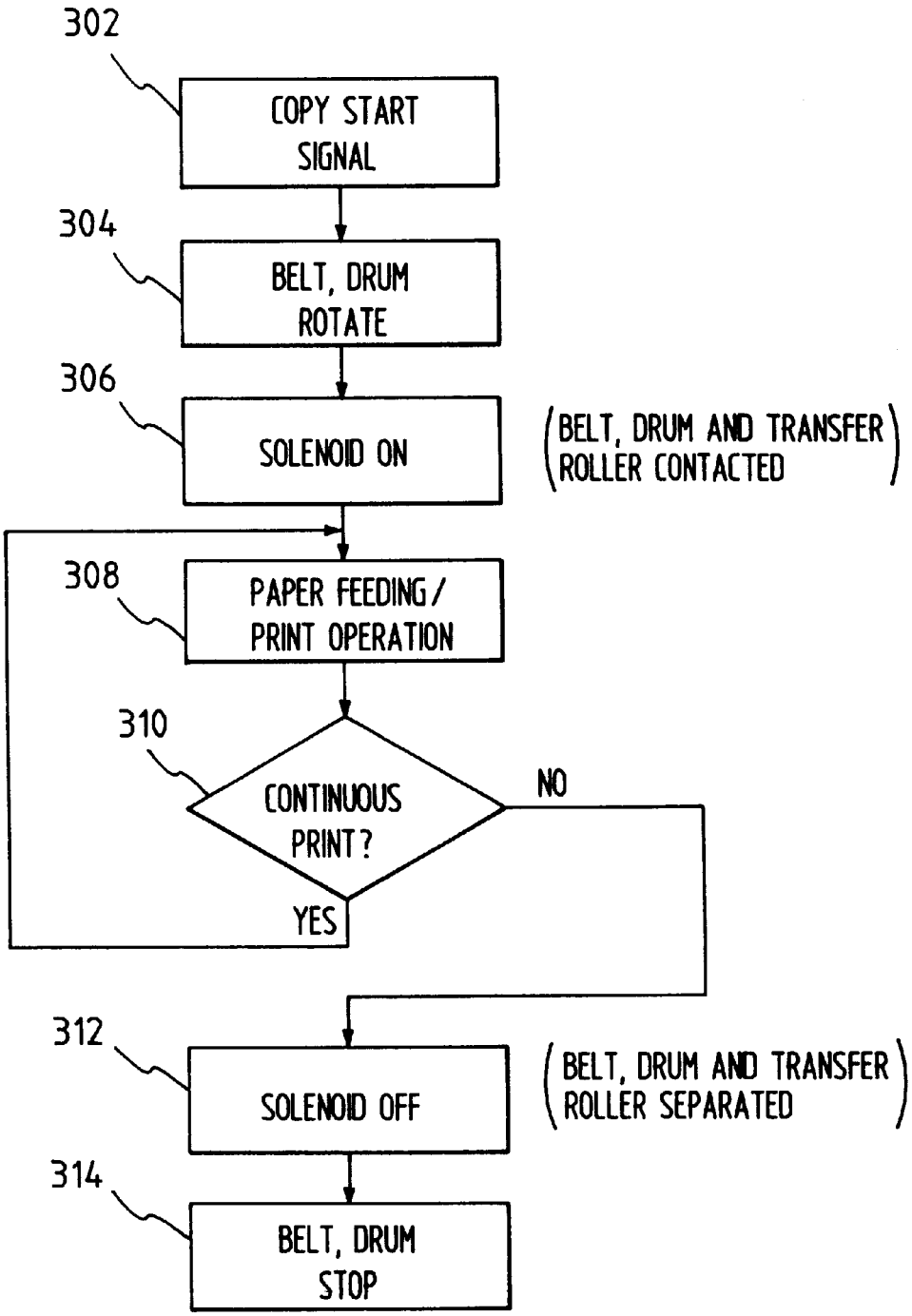
FIG. 3 is a flowchart illustrating the operation of the transferring mechanism shown in FIG. 1.

FIG. 3 shows a flowchart illustrating the operation of the electro-photographic copying apparatus 10 according to the present invention. When a copying operation start signal is applied (step 302), the belt 11 and the photosensitive drum 1 start to rotate (step 304). Then, the solenoid 22 is turned ON (step 306) and the paper feeding and the copying operation are executed. That is, when the solenoid 22 is turned ON, the transfer roller 13 is pushed up to the position shown in FIG. 2(*b*), pressing the belt 11 against the photosensitive drum 1, and the copying operation is performed on a paper transferred between the belt 11 and the photosensitive drum 1 (step 308). At this time, the transfer bias voltage is applied to the belt 11 from the high voltage source 14 via the transfer roller 13.

In the continuous copying operation (step 310), for example the copying operation on a plurality of sheets, the solenoid 22 is kept turned ON. When the next copying operation is not performed, the solenoid 22 is turned OFF (step 312) and the belt 11 and the photosensitive drum 1 stop rotating (step 314). When the solenoid 22 is turned OFF, the transfer roller 13 is urged downward by the force of the spring 21 to the downward position.

According to the embodiment described above, since the transfer roller 13 is kept away from the belt 11 during the copying operation waiting time, an image may be formed without exuding a component of the belt 11 onto the transfer roller 13.

Figure 4A:
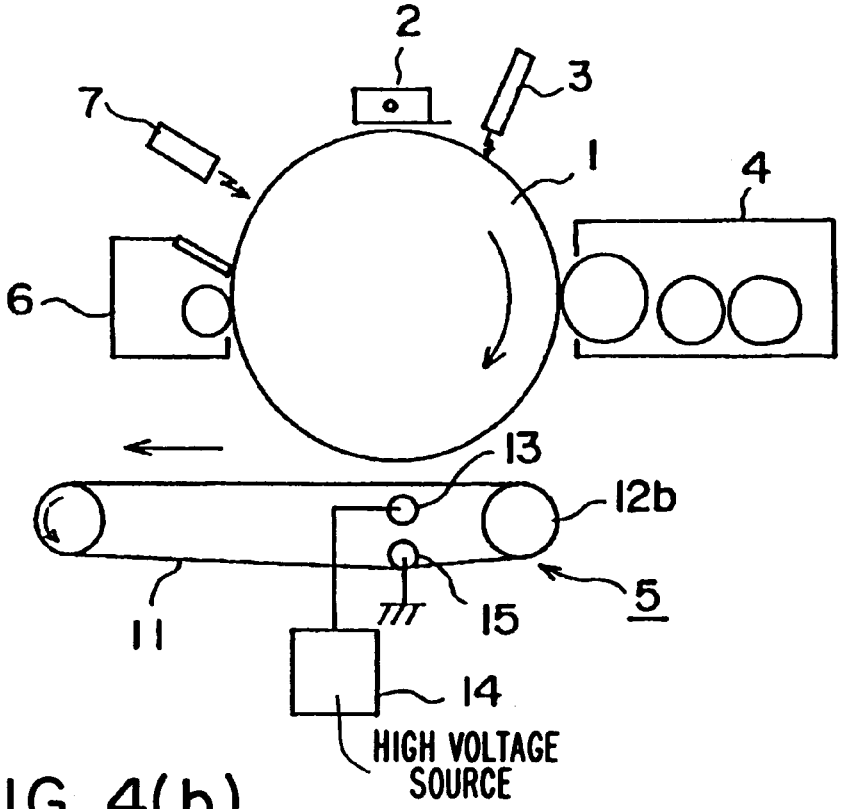
FIGS. 4(*a*) and 4(*b*) are schematic views of an electro-photographic copying apparatus according to a second embodiment of the present invention.
Figure 4B:
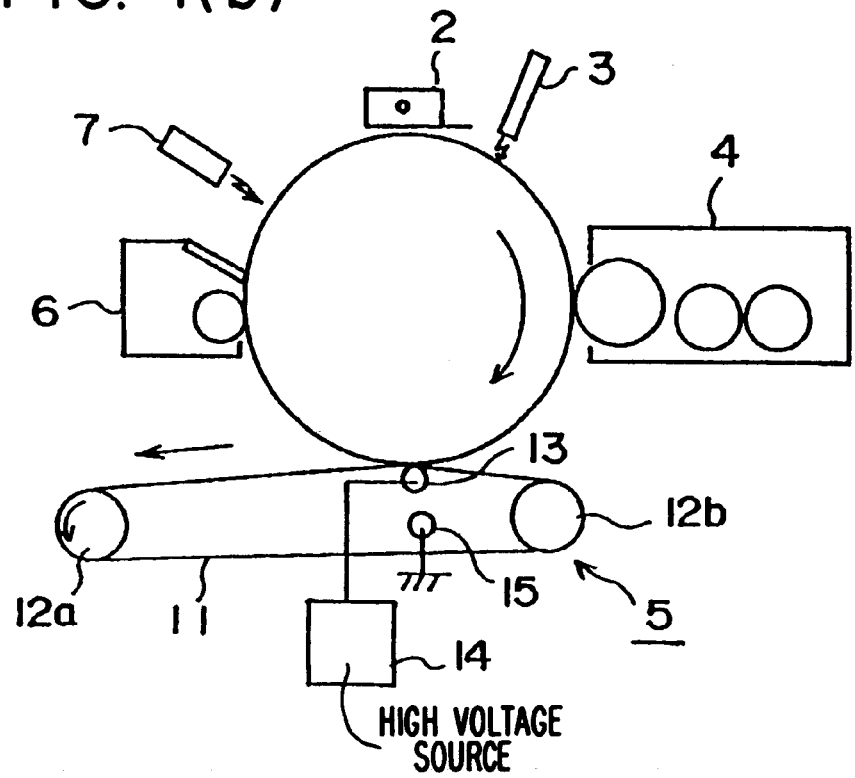

FIGS. 4(*a*) and 4(*b*) are schematic views of an electrophotographic copying apparatus according to a second embodiment of the present invention. The apparatus shown in FIGS. 4(*a*) and 4(*b*) have almost the same construction as the electro-photographic copying apparatus 10 shown in FIG. 1. The apparatus shown in FIG. 4 differs from the electro-photographic copying apparatus 10 shown in FIG. 1 by also including a tension-maintaining roller 15. The tension-maintaining roller 15 is grounded.

When the transfer roller 13 is at the lower position as shown in FIG. 4(*a*), the belt 11 is supported by several rollers including the rollers 12*a*, 12*b* at a position spaced apart from the photosensitive drum 1, for example, by about 5 mm. At this time, the transfer roller 13 and the belt 11 are also separated from each other, for example, at a distance of about 4 mm.

On the contrary, when the transfer roller 13 is at the upper position as shown in FIG. 4(*b*), the transfer roller pushes the belt 11 upward pressing the photosensitive drum 1 via the belt 11. Further, the tension-maintaining roller 15 is a metallic roller which moves together with the transfer roller 13, and when the transfer roller 13 is at the lower position, the tension-maintaining roller 15 presses down the belt 11 and maintains the belt tension at the position shown in FIG. 4(*a*). At this time, if the tension-maintaining roller 15 is grounded, the belt 11 can be discharged simultaneously by the tension-maintaining roller 15.

When the transfer roller 13 is at the upper position as shown in FIG. 4(*b*), the tension-maintaining roller 15 is separated from the belt 11. The transfer roller 13 and the tension-maintaining roller 15 are kept at the position shown in FIG. 4(*b*) during the copying operation and kept at the position shown in FIG. 4(*a*) during the copying operation waiting time. Since either of the transfer roller 13 or the tension maintaining roller 15 maintain the tension of the belt 11 by contacting the belt 11, the transfer roller 13 may be spaced apart from the belt 11 in the position of FIG. 6(*a*) at a sufficient distance to prevent an abnormal discharge.

Figure 5A:
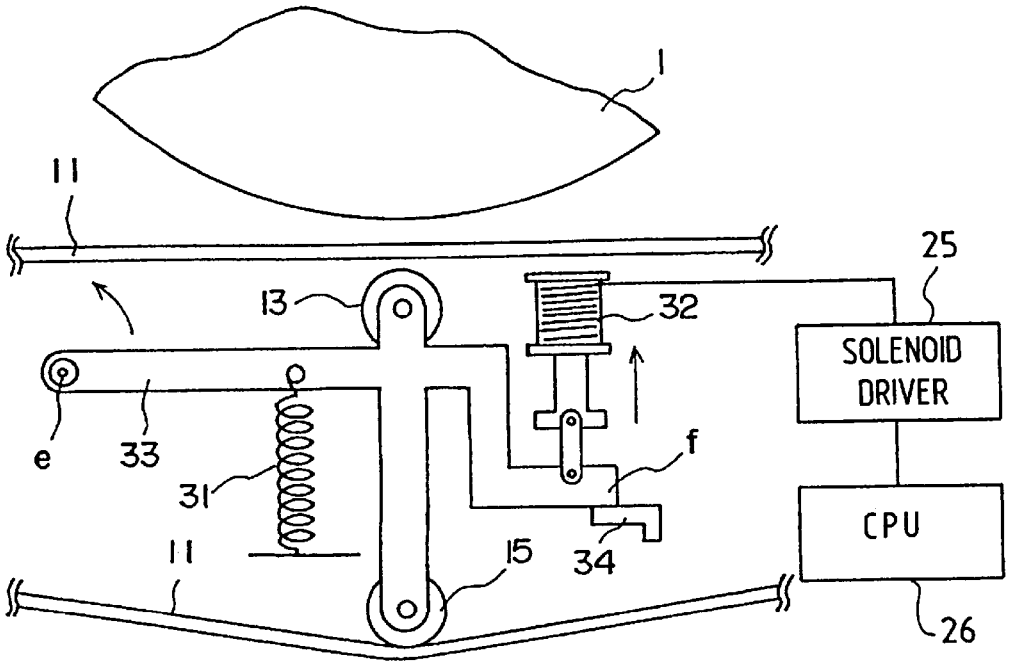
FIGS. 5(*a*) and 5(*b*) are diagrams showing a changing mechanism for changing the position of the transferring mechanism shown in FIG. 4.
Figure 5B:
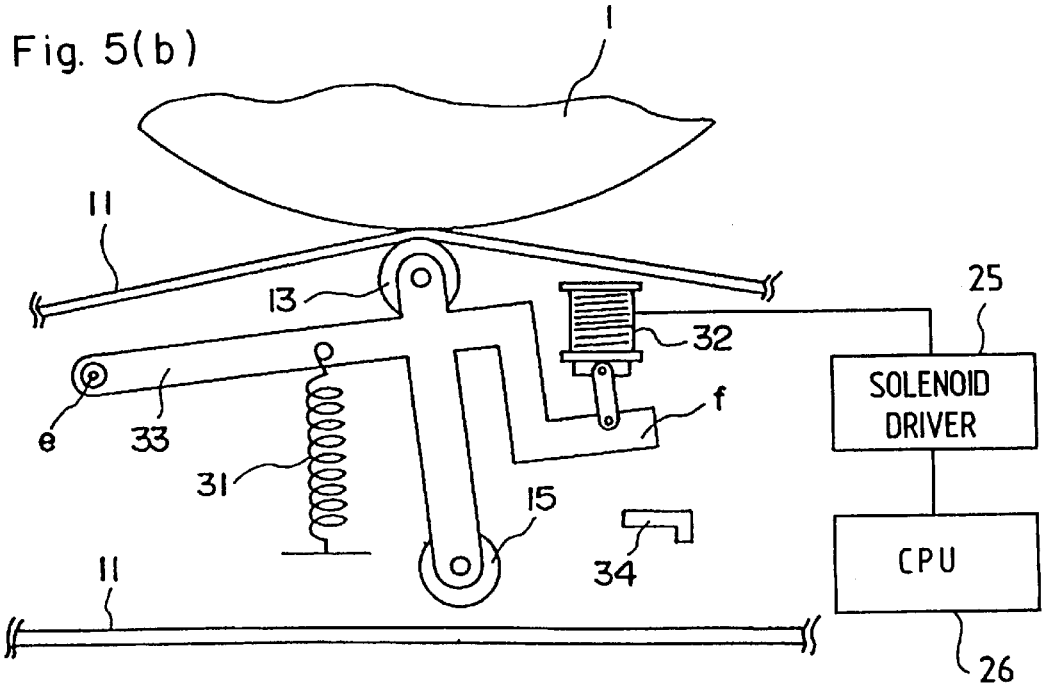

FIGS. 5(*a*) and 5(*b*) are diagrams showing a changing mechanism to change the positions of the transfer roller 13 and the tension-maintaining roller 15 according to another embodiment of the present invention. The changing mechanism comprises a solenoid driver 25, a CPU 26, a spring 31, a solenoid 32, a supporting member 33, and a positioning member 34. The spring 31 and the solenoid 32 are mounted on a supporting member 33 as shown in FIG. 5. The solenoid 32 is driven by the solenoid driver 25 which is connected to the CPU 26. The supporting member 33 is mounted at both ends of a rotating axis of the transfer roller 13 and the tension-maintaining roller 15, and also rotates pivotally about a supporting point "e".

During a copying operation waiting time, an end "f" of the supporting member 33 is urged downward by the force of the spring 31 to engage the positioning member 34 at the lower position, to disengage the transfer roller 13 from the belt 11, and to engage the tension-maintaining roller 15 on the belt 11 as shown in FIG. 5(*a*). On the other hand, during the copying operation, the end "f" of the supporting member 33 is urged upward by the solenoid 32 and the transfer roller 13 is fixed at the upper position where the belt 11 is pressed against the photosensitive drum 1 as shown in FIG. 5(*b*).

Figure 6:
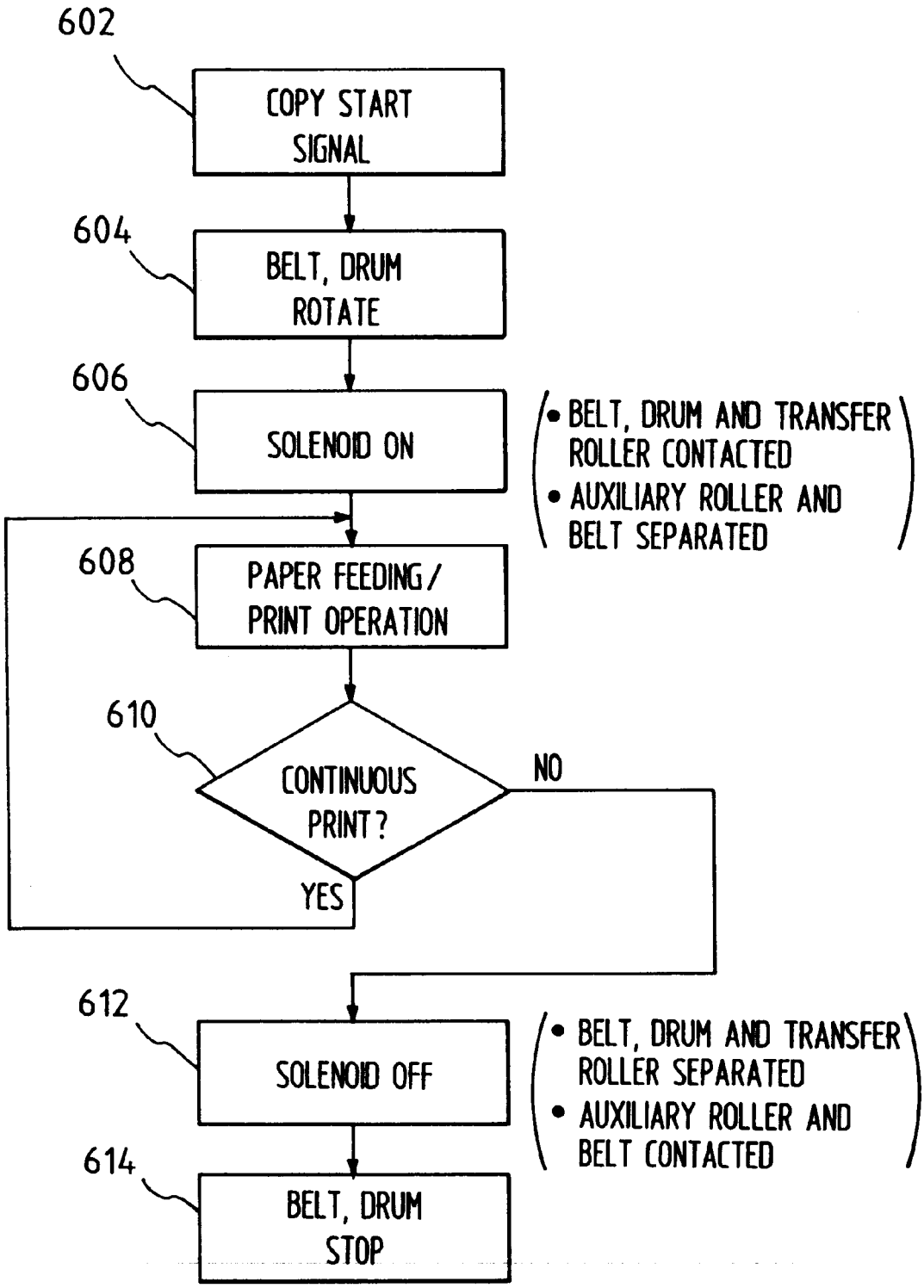
FIG. 6 is a flowchart showing the operation of the changing mechanisms and transferring mechanisms shown in FIG. 4.

FIG. 6 shows a flowchart illustrating the operation of the transfer roller 13 in the embodiment of FIG. 5 according to the present invention. When a copying operation start signal is applied (step 602), the belt 11 and the photosensitive drum 1 start to rotate (step 604). Then, the solenoid 32 is turned ON (step 606) and the paper feeding and the copying operation are executed. That is, when the solenoid 32 is turned ON, the transfer roller 13 and the tension-maintaining roller 15 are moved up to the position shown in FIG. 5(*b*), the transfer roller 13 presses the belt 11 against the photosensitive drum 1 and the copying operation onto a paper is carried out (step 608). At this time, transfer bias voltage is applied from the high voltage source 14 to the belt 11 via the transfer roller 13.

When further performing the copying operation continuously (step 610), the solenoid 32 is kept turned ON, but when the next copying operation is not performed, the solenoid 32 is turned OFF (step 612) and the belt 11 and the photosensitive drum 1 stop rotating. When the solenoid 32 is turned OFF, the transfer roller 13 and the tension-maintaining roller 15 are urged downward by the force of the spring 31 to the waiting position as shown in FIG. 5(*a*).

According to the embodiment described above, since the transfer roller 13 is kept away from the belt 11 during the copying operation waiting time, an image may be formed without exuding a component of the belt 11 onto the transfer roller 13. Further, since the tension-maintaining roller moves in accordance with the motion of the transfer roller, the tension of the belt 11 is always kept substantially constant.

Figure 7:
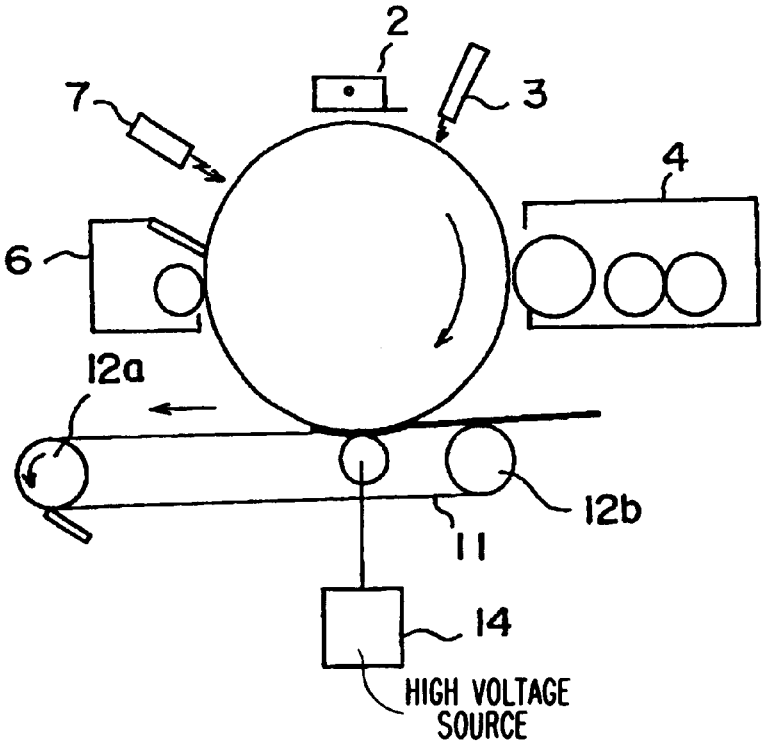
FIG. 7 is a schematic view of an electro-photographic copying apparatus according to a third embodiment of the present invention.

FIG. 7 is a schematic view of an electro-photographic copying apparatus according to a third embodiment of the present invention. The construction of the apparatus shown in FIG. 7 is almost the same as the electro-photographic copying apparatus 10 shown in FIG. 1. In the third embodiment, the apparatus is so constructed that the peripheral velocities of the photosensitive drum 1 and the belt 11 are kept the same not only in the steady rotating time, but also in the period from the start of rotation to the steady rotating state (the accelerating state) and the period from the steady rotating state to stop of the rotation (the deceleration state).

Figure 8:
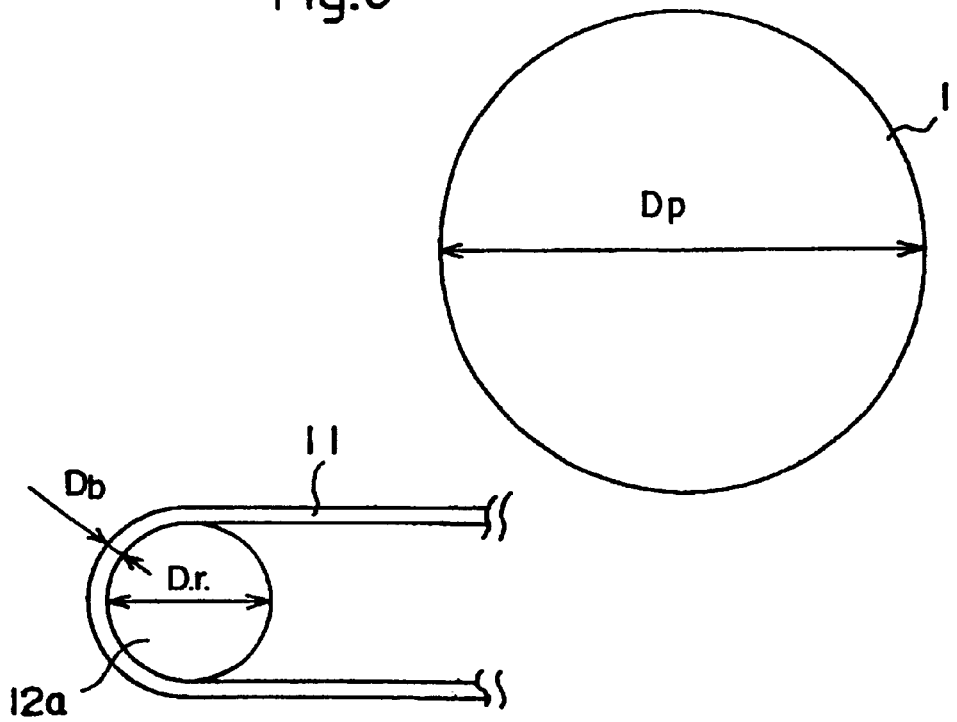
FIG. 8 is a diagram showing the diameter of the image carrier and the structure of the conveying device of the apparatus of FIG. 7.

FIG. 8 is a diagram showing the diameter of the image carrier and the structure of the conveying device. That is, an outer diameter of the photosensitive drum 1 is Dp, the thickness of the belt 11 is Db, and the outer diameter of the driving roller 12 of the belt 1 is Dr as shown in FIG. 8. The outer diameter Dp of the photosensitive drum 1, the thickness Db of the belt 11, and the outer diameter Dr of the driving roller 12*a* of the belt 11 are selected so as to satisfy the relation:

$$Dp=n\times(Dr+2\times Db) \text{ (n is a positive integer).}$$

Figure 9:
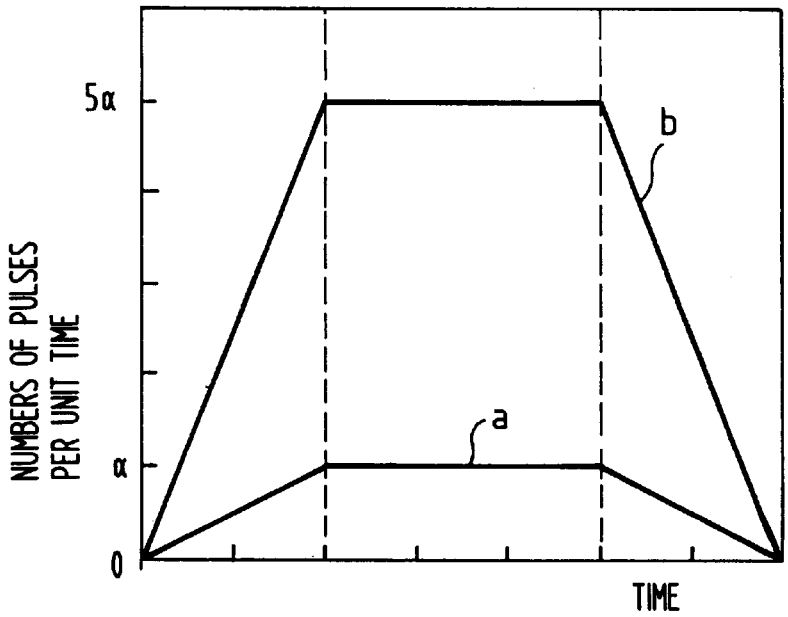
FIG. 9 is a diagram showing the relation between time and numbers of pulses of a pulse motor for driving the conveying device of FIG. 7.

FIG. 9 shows the running curves of pulses of pulse motors for driving the photosensitive drum 1 and the driving roller 12*a*. Line a shows the numbers of pulses for driving the photosensitive drum 1, and line b shows the numbers of pulses for driving the driving roller 12*a*. That is, when the number of pulses per unit time of the pulse motor for driving the photosensitive drum 1 is Np, the number of pulses per unit time of the pulse motor for driving the driving roller 12*a* is Nr, the pulse motors are set so as to always satisfy the relation Nr=n×Np in both periods of acceleration and deceleration. Further, the pulse motors for driving the photosensitive drum 1 and the driving roller 12*a* are operated based on the same clock and synchronized while driving the drum 1 and the belt 11. The number n is set as 5 (n=5) in FIG. 9.

Figure 10:
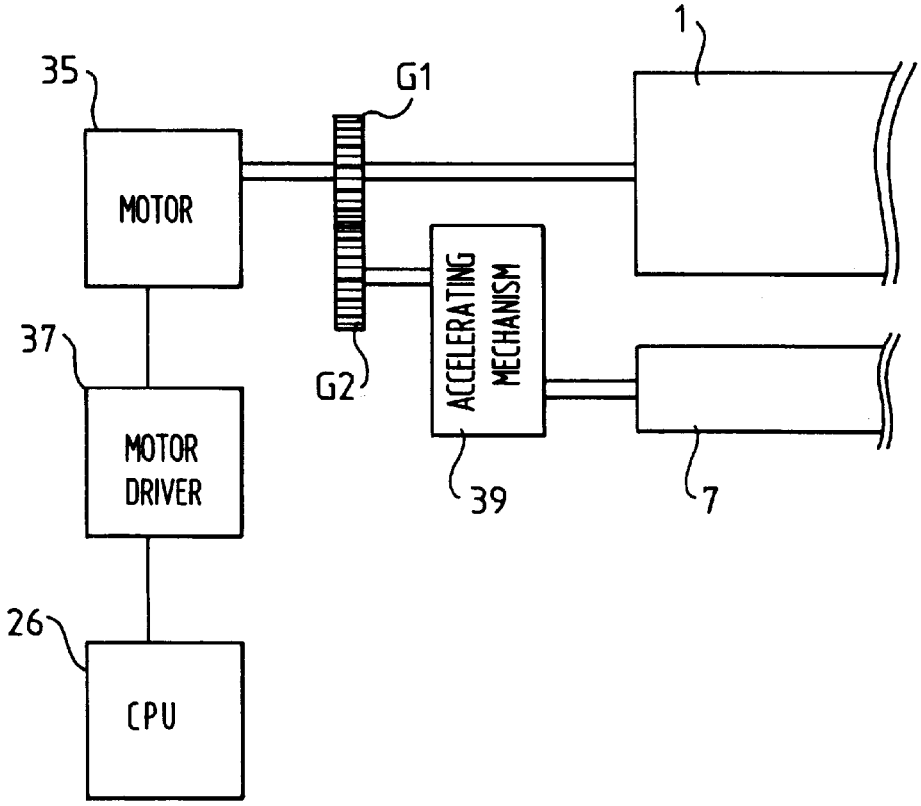
FIG. 10 is a diagram showing a mechanism to maintain peripheral velocities of the image carrier and the conveying mechanism shown in FIG. 7 equal to each other.

FIG. 10 is a diagram showing a mechanism for maintaining the peripheral velocities of the image carrier and the conveying device. As an another method to maintain the peripheral velocities of the photosensitive drum 1 and the belt 11 to be equal not only during the steady rotating time but also during the period of acceleration and deceleration, the driving mechanism shown in FIG. 10 is used. The driving mechanism includes a CPU 26, a motor 35, a motor driver 37, an accelerating mechanism 39, and first and second gears G1 and G2, respectively. The motor 35 is driven by the motor driver 37, which is connected to the CPU 26, which operates as a controller to the motor driver 37. The driving force of the driving motor 35 is divided into two forces by using the first gear G1 and the second gear G2. The accelerating mechanism 39 uses these two forces for acceleration or deceleration to obtain a desirable peripheral velocity.

For example, the outer diameter of the photosensitive drum 1 is Dp, the thickness of the belt 11 is Db, and the outer diameter of the belt driving roller 12*a* is Dr. The peripheral velocities of the photosensitive drum 1 and the belt 11 may be controlled to be equal by selecting the diameters Dp, Db so as to satisfy the relation Dp=n×(Dr+2×Db) (n is a positive integer), and by controlling the numbers of rotation of the driving roller 12*a* Mr against the number of rotation of the photosensitive drum Mp so as to satisfy the relationship Mr=n×Mp.

Figure 11:
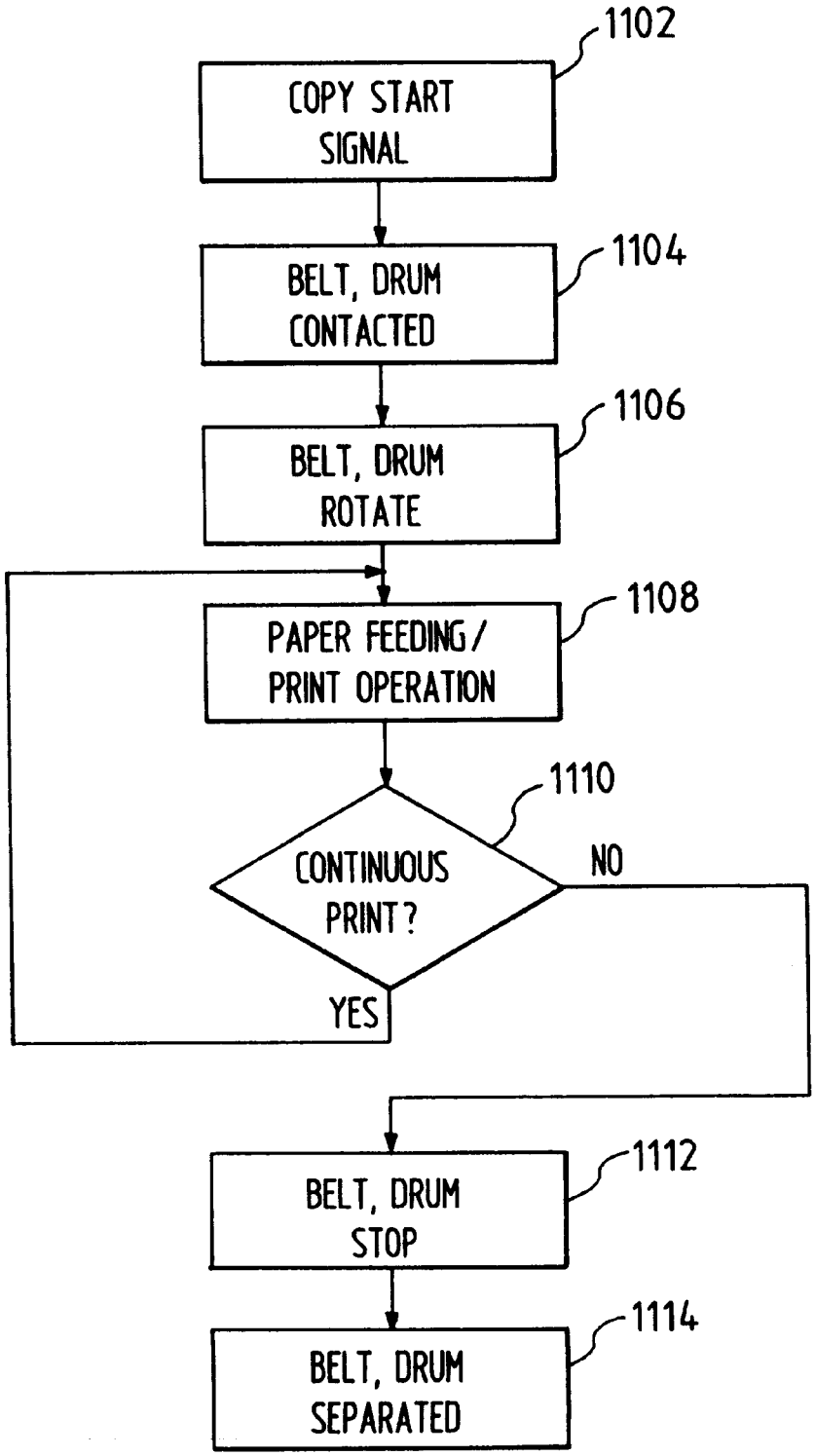
FIG. 11 is a flowchart showing the driving operation of the conveying mechanism shown in FIG. 7.
Figure 12A:
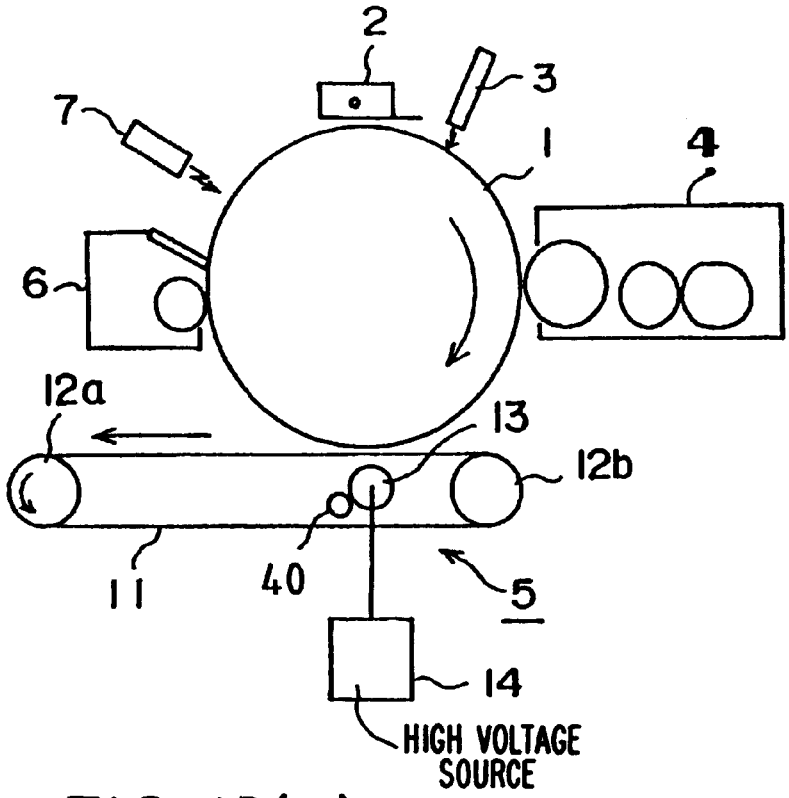
FIGS. 12(*a*) and 12(*b*) are schematic views of an electro-photographic copying apparatus according to a fourth embodiment of the present invention.
Figure 12B:
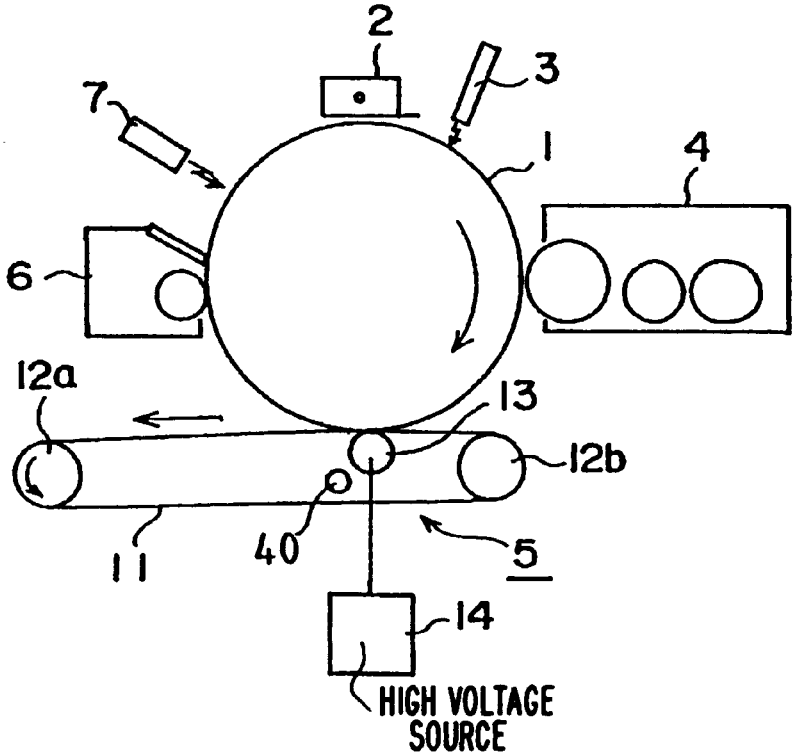

FIG. 11 shows a flowchart illustrating the operation of the transfer roller 13 in the embodiment of FIG. 12. First, when a copying operation start signal is applied (step 1102), the belt 11 and the photosensitive drum 1 are brought into contact with each other by a belt contacting/separating mechanism having almost the same construction described in the first embodiment of FIG. 1, (step 1104). Both the photosensitive drum 1 and the belt 11 start to rotate simultaneously (step 1106). After they come to rotate at the steady velocities, the paper feeding and copying operation is performed (step 1108).

If a continuous copying operation is performed (step 1110), the rotation is continued and if the next copying operation is not performed, the rotation speed of the photosensitive drum 1 and the belt 11 are decelerated until both stop (step 1112). Thereafter, both of them are separated from each other by the belt contacting/separating mechanism (step 1114).

The embodiment described above reduces wear of the belt and the photosensitive drum 1. That is, since the peripheral velocities of the photosensitive drum 1 and the driving roller 12*a* for driving the belt 11 are kept equal during acceleration and deceleration, it is possible to reduce wear and damage of the belt 11 and to form an excellent image.

FIGS. 12(*a*) and 12(*b*) are schematic views of an electrophotographic copying apparatus according to a fourth embodiment of the present invention. The construction of the apparatus shown in FIG. 12 is almost the same as that of the apparatus shown in FIG. 1. In the embodiment shown in FIG. 12, the apparatus comprises a cleaner 40 for cleaning the surface of the transfer roller 13. A mechanism to change the position of the transfer roller 13 is the same as that shown in FIG. 5.

Figure 13A:
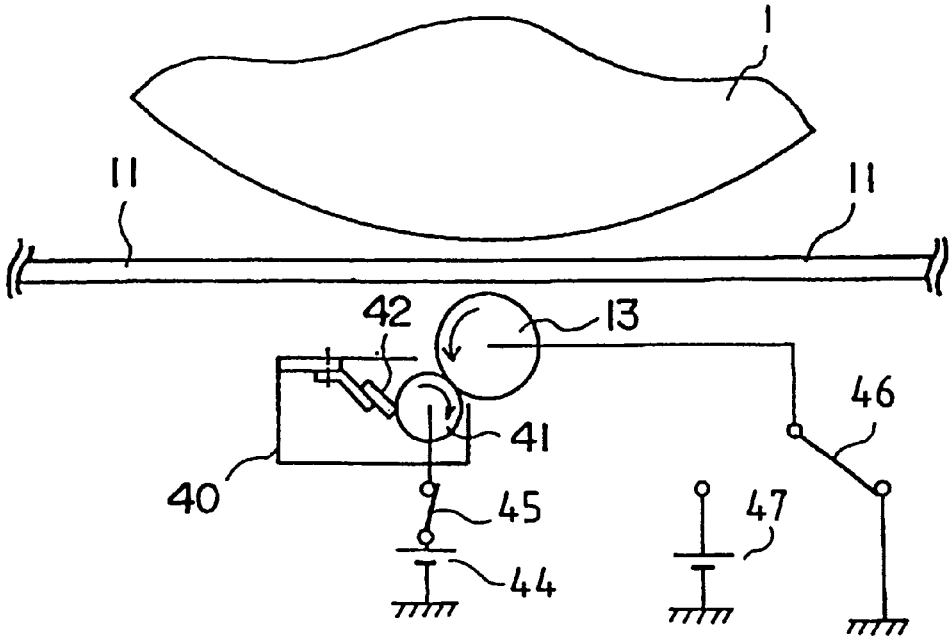
FIGS. 13(*a*) and 13(*b*) are schematic views showing a cleaning mechanism for cleaning a surface of the transferring mechanism of the apparatus shown in FIG. 12.
Figure 13B:
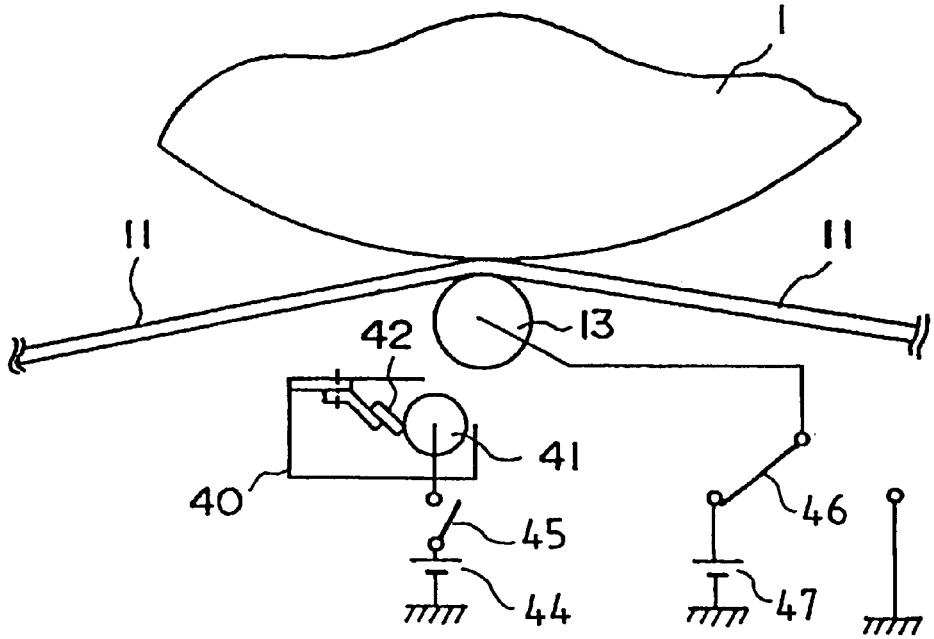

FIGS. 13(*a*) and 13(*b*) are schematic views showing the cleaner 40 for cleaning a surface of the transfer roller 13. The cleaner 40 includes a conductive roller 41 and a rubber blade 42. The conductive roller 41 is connected to a power source 44 via a switch 45. The rubber blade 42 engages the surface of the conductive roller 41.

As shown in FIG. 12(*a*) and FIG. 13(*a*), when the transfer roller 13 is at the lower position, the conductive roller 41 is kept in contact with the transfer roller 13 to clean the surface of the transfer roller 13. During the cleaning, the transfer roller 13 is kept grounded via a switch 46 and applied with a voltage of several hundred volts by the conductive roller 41. The conductive roller 41 electrostatically recovers toner adhered on the transfer roller 13 in this method. The toner recovered by the conductive roller 41 is scraped off from the conductive roller 41 by the rubber blade 42. The scraped toner is recovered in the cleaner 40. This cleaning operation is carried out periodically, for example, one time every 5,000 sheets of copying operation.

As shown in FIG. 12(*b*) and FIG. 13(*b*), when the transfer roller 13 is at the upper position, the conductive roller 41 is separated from the transfer roller 13 and is kept in the electrically floating state via a power source 47.

Figure 14:
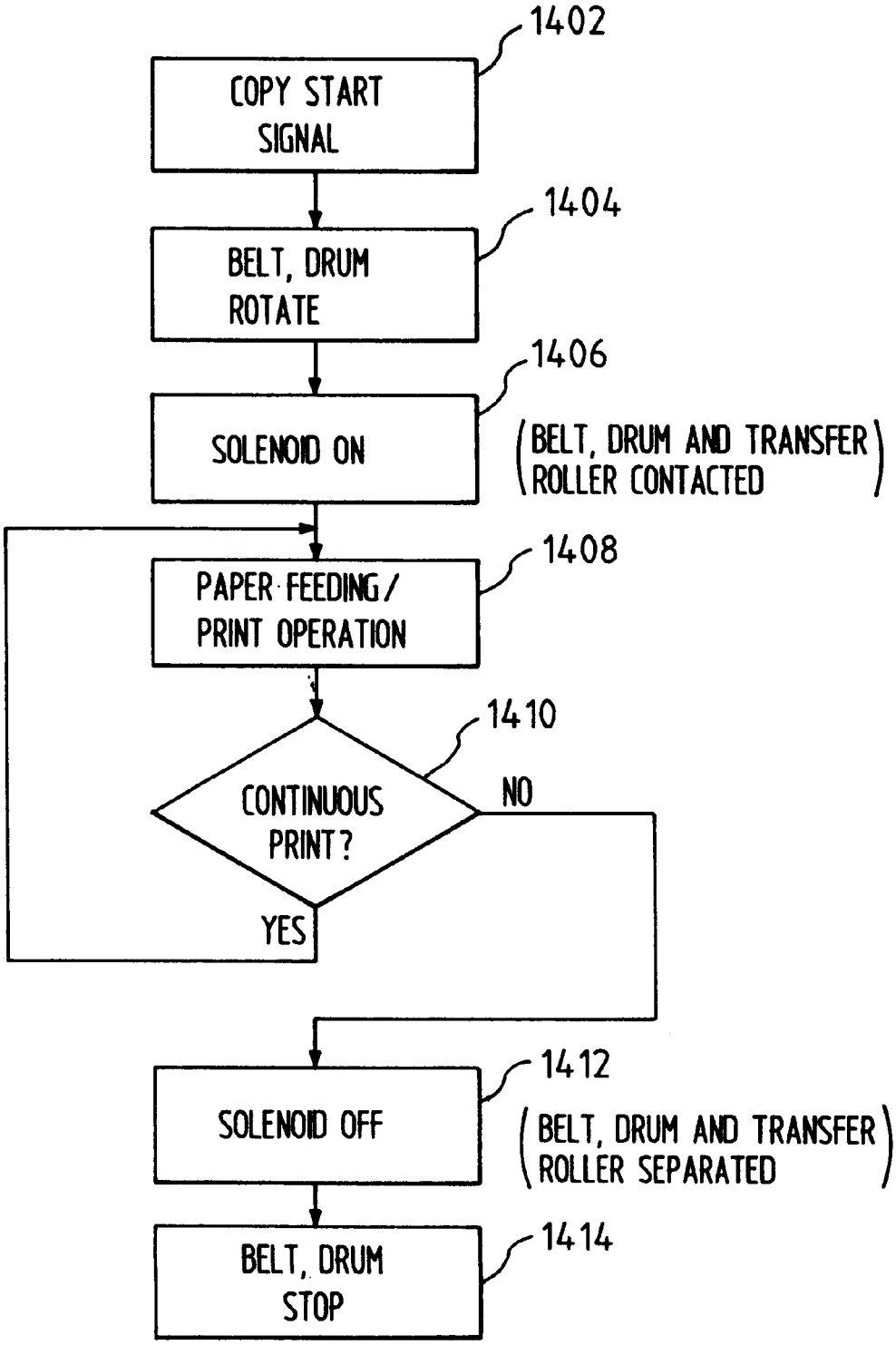
FIG. 14 is a flowchart showing the operation of the electro-photographic copying apparatus shown in FIG. 12.

FIG. 14 shows a flowchart illustrating the operation of the transfer roller 13 of the embodiment of FIG. 12. When a copying operation start signal is applied (step 1402), the belt 11 and the photosensitive drum 1 rotate (step 1404). Then, the solenoid 22 is turned ON (step 1406) and the paper feeding and copying operation are executed (step 1408). That is, when the solenoid 22 is turned ON, the transfer roller 13 is pushed up to the position shown in FIG. 13(*b*), the belt 11 is pressed against the photosensitive drum 1 and the copying operation is performed on a paper that is transferred between the belt 11 and the photosensitive drum 1. At this time, a transfer bias voltage is applied to the belt 11 from the high voltage source 14 via the transfer roller 13. Further, the conductive roller 41 is separated from the transfer roller 13.

If a continuous copying operation is performed (step 1410), the solenoid 22 is kept as it is, but if no copying operation is performed, the solenoid 22 is turned OFF (step 1412) and the belt 11 and the photosensitive drum 1 stop rotating (step 1414). When the solenoid 22 is turned OFF, the transfer roller 13 is urged downward by the force of the spring 21 to the waiting position. The cleaning operation is executed at this time. The transfer roller 13 is applied with a positive voltage of several hundred volts. The toner adhered on the transfer roller 13 is electrostatically recovered. The toner recovered by the conductive roller 41 is scraped off from the conductive roller 41 by the rubber blade 42 and collected in the cleaner 40.

According to the embodiment described above, since the transfer roller is kept away from the belt 11 during the copying operation waiting time, it is possible to form an image without exuding a component of the belt 11 onto the transfer roller 13. Further since the transfer roller is cleaned when the transfer roller is away from the belt 11, an image may be formed without pollution of the transfer roller 13 and the belt 11.

Figure 15:
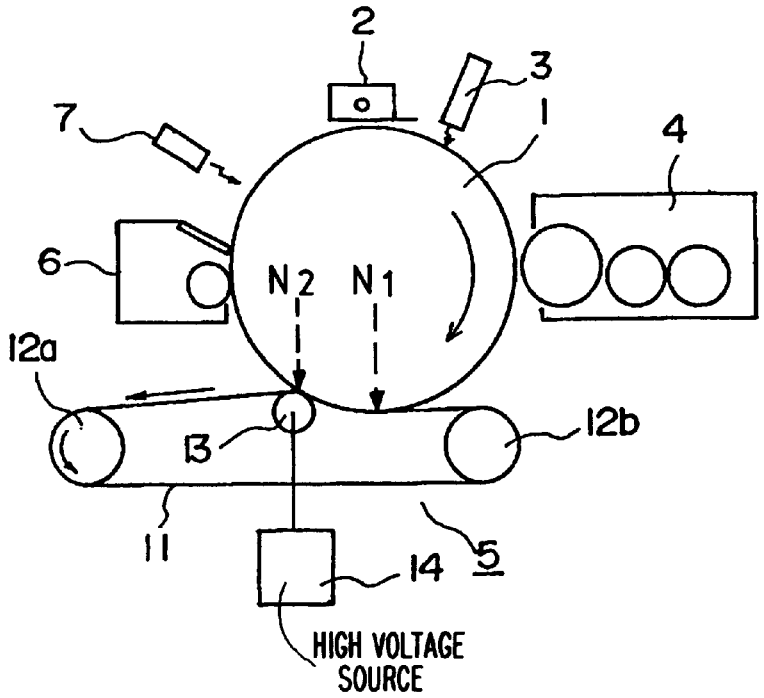
FIG. 15 is a schematic view of a electro-photographic copying apparatus according to a fifth embodiment of the present invention.

FIG. 15 shows a mechanism to change a transfer nip (between N1–N2 in FIG. 15) that is formed between the photosensitive drum 1 and the belt 11. That is, the transfer roller 13 moves along the outer surface of the photosensitive drum 1 depending on the environment to change the transfer nip and to obtain an optimum transfer condition.

Figure 16:
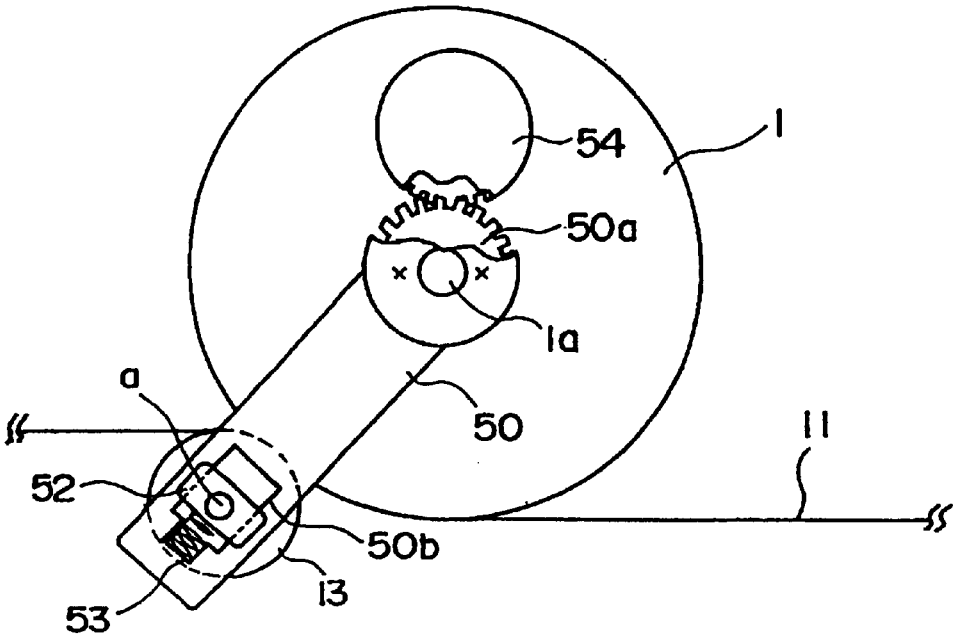
FIG. 16 is a diagram showing a transfer nip changing mechanism in the electro-photographic copying apparatus shown in FIG. 15.

FIG. 16 is a diagram showing a mechanism to move the transfer roller 13 along the outer surface of the photosensitive drum 1. The mechanism comprises a member 50, a gear 50*a*, a guide 50*b*, a bearing 52, a spring 53 and a stepping motor 54. In this mechanism, the gear 50*a* has a center fitted to the shaft 1*a* of the photosensitive drum 1 and is mounted at one end of a member 50. The gear 50*a* engages the gear 54 which is coupled to a stepping motor (not shown). A shaft 13*a* of the transfer roller 13 is mounted at the other end of the member 50 via the guide 50*b* and the bearing 52. The bearing 52 is slid on the guide 50*b* by a spring 53 and presses the transfer roller 13 against the photosensitive drum 1 via the belt 11.

The rotation of the stepping motor 54 determines the position of the transfer roller 13. Further, the belt and the photosensitive drum can be separated by a solenoid (not shown) by pushing the bearing 52 in the compressing direction of the spring 53.

Under a low temperature and low humidity environment, the resistance of the belt 11 and paper become higher than that under an ordinary environment. The transfer roller 13 is moved in the direction to reduce the transfer nip, that is, to the upper left as shown in FIG. 16 under a low temperature and low humidity environment. On the other hand, under the high temperature and high humid environment, the resistance of the belt 11 and that of paper drop, and, therefore, the transfer roller 13 is moved in the direction to increase the nip, that is, to the lower right in FIG. 16.

The mechanism for changing the transfer nip may be applied to the copying apparatuses described above.

The present invention is not limited to the above described embodiments, and variations and modifications may be made without departing from the scope of the present invention.

What is claimed is:

1. An image forming apparatus, comprising:

image forming means for forming an image on an image carrier;

transfer means for transferring the image formed on the image carrier onto an image receiving member;

conveying means for conveying the image receiving member to a position for the transfer of the image from the image carrier, moving means for moving the transfer means between a first position where the transfer means urges the conveying means toward the image carrier, thereby bringing the conveying means into contact with the image carrier, and a second position where the transfer means is spaced apart from the conveying means, thereby moving the conveying means away from the image carrier;

controlling means for controlling the moving means so that the transfer means is positioned at the first position when the image forming means is operable, and the transfer means is positioned at the second position when the image forming means is not operable; and cleaning means for cleaning the transfer means when the transfer means is positioned at the second position.

2. An image forming apparatus according to claim 1, wherein the transfer means is positioned at a second position after the image forming means forms an image.

3. An image forming apparatus according to claim 1, wherein the conveying means includes a conveyor belt and the transfer means includes a transfer roller.

4. An image forming apparatus according to claim 3, wherein the controlling means controls a position of the transfer roller against the conveyor belt.

5. An image forming apparatus according to claim 3, further comprising tension maintaining means for maintaining tension of the conveyor belt when the transfer roller is positioned at the second position.

6. An image forming apparatus according to claim 5, wherein the tension maintaining means includes a discharge means for discharging the belt when the transfer roller is positioned at the second position.

7. An image forming apparatus according to claim 3, wherein the cleaning means is spaced apart from the transfer roller when the transfer roller is positioned at the first position.

8. An image forming apparatus according to claim 3, wherein the cleaning means includes a cleaning roller in contact with the transfer roller when the transferring means is the second position, bias voltage supplying means for supplying the cleaning roller with a bias voltage, and a blade in contact with the cleaning roller.

9. An image forming apparatus according to claim 3, wherein the transfer roller moves along a periphery of the image carrier.

10. An image forming apparatus comprising:

image forming means for forming an image on an image carrier;

transfer means for transferring the image formed on the image carrier onto an image receiving member;

conveying means, provided in contact with the image carrier, for conveying the image receiving member to a position for the transfer of the image from the image carrier;

first driving means for driving the image carrier;

second driving means for driving the conveying means, said second driving means including a driving roller for supporting the conveying means thereon; and controlling means for controlling the first driving means and the second driving means so that the image carrier and the conveying means move in same speed while the moving speed of the image carrier and the conveying means is changing, wherein a relation $Dp=nX\ (Dr+2\times Db)$ is satisfied where an outer diameter of the image carrier is Dp, a thickness of the conveying means is Db, an outer diameter of the driving roller is Dr, and n is a positive integer.

11. An image forming apparatus according to claim 10, wherein the controlling means controls the first driving means and the second driving means while the moving speed of the image carrier and the conveying means is accelerated.

12. An image forming apparatus according to claim 10, wherein the controlling means controls the first and the second driving means while the moving speed of the image carrier and the conveying means is decelerated.

13. An image forming apparatus according to claim 10, wherein the second driving means includes a driving roller and the conveying means includes a conveyor belt put on the driving roller.

14. An image forming apparatus according to claim 10, wherein $Nr=n\times Np$ is satisfied where the number of pulses per unit time of a pulse motor for driving the image carrier is Np, and a number of pulses per unit time of a pulse motor for driving the driving roller is Nr.

15. An image forming apparatus according to claim 10, wherein the transfer means includes a transfer roller, the transfer roller moves along a periphery of the image carrier.

16. An image forming apparatus according to claim 10, further comprising moving means for moving the transfer means between a first position where the transfer means press the conveying means to the image carrier, thereby bringing the conveying means into contact with the image carrier, and a second position where the transfer means is spaced apart from the conveying means, thereby bringing the conveying means away from the image carrier.

* * * * *